United States Patent [19]

Steltenkamp et al.

[11] Patent Number: 4,715,862

[45] **Date of Patent: * Dec. 29, 1987**

[54] WASH CYCLE FABRIC CONDITIONING COMPOSITION, PROCESS FOR MANUFACTURE OF SUCH COMPOSITION, AND METHOD OF USE THEREOF

[75] Inventors: Robert J. Steltenkamp, Somerset; Michael A. Camara, Jackson, both of N.J.

[73] Assignee: Colgate-Palmolive Company, New York, N.Y.

[ * ] Notice: The portion of the term of this patent subsequent to Jul. 28, 2004 has been disclaimed.

[21] Appl. No.: 939,653

[22] Filed: Dec. 8, 1986

Related U.S. Application Data

[63] Continuation-in-part of Ser. No. 716,871, Mar. 27, 1985, Pat. No. 4,682,982.

[51] Int. Cl.[4] ..... D06M 13/40

[52] U.S. Cl. ..... 8/137; 252/8.8; 252/525; 252/544

[58] Field of Search ..... 8/137; 252/8.8, 525, 252/544

[56] References Cited

U.S. PATENT DOCUMENTS

| | | | |
|---|---|---|---|
| 3,835,148 | 9/1974 | Oxe et al. | 524/913 |
| 3,843,543 | 10/1974 | Hewitt | 252/153 |
| 4,075,117 | 2/1978 | Morton et al. | 252/534 |
| 4,076,631 | 2/1978 | Caruso et al. | 252/8.8 |
| 4,418,011 | 11/1983 | Bauman et al. | 252/544 |
| 4,497,715 | 2/1985 | Bauman | 252/525 |

*Primary Examiner*—Robert Wax

*Attorney, Agent, or Firm*—H. S. Sylvester; M. M. Grill; N. Blumenkopf

[57] ABSTRACT

A wash cycle fabric conditioning composition, which makes laundry washed in an automatic washing machine and dried in an automatic laundry dryer resistant to the accumulation of static charges thereon, and which may be in particulate, liquid, or other suitable form, comprises an antistatic N-higher alkyl neoalkanamide or an antistatic N-higher alkenyl neoalkanamide, or a mixture thereof, and a detergent builder, such as a water soluble builder salt or a zeolite, or a mixture thereof, as a carrier, or an aqueous medium containing a nonionic surface active agent. Specifically preferred neoalkanamides of the type described are N-higher alkyl neodecanamides, such as tallowalkyl neodecanamide. In some instances, bentonite may be included in the particulate compositions to soften the fabrics that are washed, and tertiary amines may be formulated into the liquid compositions to increase fabric softening action. Despite the fact that the conditioning composition is added to the was water in the wash cycle of the automatic washing machine, the neoalkanamide thereof does not react adversely with anionic detergents in the wash water, (unlike quaternary ammonium halide antistatic agents) so the cleaning power of the detergent in the wash water is not comprised, even when the detergent employed is an anionic detergent.

Also within the invention are a process for manufacturing the particulate fabric conditioning composition and a method of using the compositions described.

12 Claims, No Drawings

WASH CYCLE FABRIC CONDITIONING COMPOSITION, PROCESS FOR MANUFACTURE OF SUCH COMPOSITION, AND METHOD OF USE THEREOF

This application is a continuation-in-part of our U.S. patent application Ser. No. 716,871, filed Mar. 27, 1985, now U.S. Pat. No. 4,682,982, issued July 28, 1987.

This invention relates to a wash cycle fabric conditioning composition which, when added to the wash cycle during automatic washing machine washing of laundry, makes the washed laundry antistatic, even after it is dried in an automatic laundry dryer. More particularly, the invention is of such compositions which contain, as an antistatic agent, an antistatic N-higher alkyl neoalkanamide or an N-higher alkenyl neoalkanamide, or any mixture thereof. The invented compositions may be in particulate, liquid or other suitable form.

The neoalkanamide antistatic agents mentioned above are disclosed in our parent U.S. patent, also referred to above. That patent describes processes for the manufacture of such compounds, and teaches uses thereof in detergent compositions, as antistats. Such patent also describes the significant advantages of the mentioned neoalkanamides over previously employed antistats, such as cationic compounds, e.g., quaternary ammonium halides, which react adversely with anionic detergents in wash waters. Additionally, the patent describes various physical characteristics of the mentioned neoalkanamides. Accordingly, it is incorporated in this application by reference.

The N-higher alkyl and alkenyl neoalkanamides employed in making the compositions of this invention may be those of neoalkanoic acids of 5 to 16 carbon atoms, such as neopentanoic, neoheptanoic, neononanoic, neodecanoic, neododecanoic, neotridecanoic and neotetradecanoic acids. Some of such neoacids (neopentanoic acid and neodecanoic acid) are presently being marketed by EXXON Chemical Americas and are described in a bulletin of such company entitled Neo Acids Properties, Chemistry and Applications(copyright 1982). To manufacture such compounds the neoacids may be reacted directly with a higher alkyl or higher alkenyl amine, which is very preferably a linear primary amine. The higher alkyl amines and higher alkenyl amines employed are normally of a number of carbon atoms in the range of 8 to 20, preferably 10 or 12 to 18. Among the more preferred of such amine starting materials are cocoalkyl amine, tallowalkyl amine (which contains a minor proportion of oleylamine), hydrogenated tallowalkyl amine, lauryl, myristyl, palmityl:and stearyl amines.

The wash cycle additive compositions of this invention are primarily employed for their antistatic effects but may also impart fabric softening to laundry items washed in a wash water containing such additive. The compositions are intended for employment with conventional built detergent compositions, which do not contain an antistat. Thus, the homemaker may add the present wash cycle fabric conditioning composition to a wash water which contains a conventional built detergent composition, and the laundry washed with it will then become antistatic. By employing a wash cycle additive it becomes unnecessary for the person operating the washing machine to listen for the end of the wash cycle and then make a special trip to the laundry room to add fabric softener to the rinse. The neoalkanamides of the present wash cycle additive compositions do not react adversely with anionic detergents, which are normally present in conventional built detergent compositions, and therefore, detergency is not adversely affected by use of the present wash cycle additive compositions.

In addition to the neoalkanamide active ingredient component of the present compositions, there will be present as a carrier, for the particulate composition embodiments of this invention, a water soluble or insoluble builder or filler. Among the water soluble builders are the polyphosphate, carbonate, bicarbonate, sesquicarbonate, silicate, sesquisilicate, polyacetal carboxylate and borate salts. Among the water insoluble builders those most preferred are the zeolites. The filler most desirably employed is sodium sulfate, but other salts are also useful. Among the phosphates there may be mentioned the polyphosphates, preferably sodium tripolyphosphate and tetrasodium pyrophosphate, although other water soluble phosphates and other builder salts, such as alkali metal salts, may also be employed. The polyacetal carboxylate utilized will normally have a molecular weight in the range of 3,000 to 15,000. The preferred zeolite is hydrated Zeolite A, which normally contains from 15 to 25% of moisture, as water of hydration.

In a preferred embodiment of the particulate composition aspect of the invention there may also be present bentonite powder, for its fabric softening activity. The bentonite employed is preferably a western or Wyoming bentonite, which is referred to as sodium bentonite, and which is also sometimes called a swelling bentonite. Such material normally contains at least 2% of moisture and preferably at least 4% of moisture as moisture of hydration in the bentonite, and the presence of such moisture helps to make the bentonite effective as a fabric softener.

Various adjuvants may be present in the particulate wash cycle additive composition, including colorants, perfumes, fluorescent brighteners, enzymes, antioxidants, stabilizers, bleaching agents and activators, binders and fluffing agents. Also, the product will contain a minor proportion of moisture.

The wash cycle fabric conditioning composition may be made in particulate form by blending particulate components of desired particle sizes. Normally, the composition will be of sizes in the range of Nos. 8 to 140, U.S. Sieve Series, and preferably such will be in the range of Nos. 10 to 100. Preferably, when making the particulate product, the builder or mixture of builders will be crutched and spray dried, after which the neoalkanamide, in liquid state (usually heated to above its melting point) will be mixed with or sprayed onto the spray dried detergent builder beads and will penetrate such beads and coat them. If bentonite is being employed, it (and any other powdered components, such as enzymes) may be mixed with the coated builder beads and may adhere to the surfaces thereof, to facilitate flow when such surfaces are tacky. Other components of the composition may be crutched with the builder and spray dried with it, if heat stable, or may be post-added, as may be preferred.

The proportions of components of the present particulate composition will normally be effective proportions for the purposes for which the components are added. Thus, in the charge of additive to the wash water, which is normally in the range of 0.2 to 2 g./l. for the described compositions, there will be enough antistat present to make the washed and dried laundry antistatic or free of static cling. The proportion of builder employed need not be a building proportion because builder will be present in the built detergent composition normally present in the wash water of automatic washing machines. However, the builder in the additive, in addition to functioning as a carrier, also supplements the action of the builder in the detergent composition. When bentonite is present, it will be present in such proportion as to noticeably soften the washed and dried laundry. Normally, the proportion of neoalkanamide will be in the range of 5 to 30% by weight, preferably 5 to 25% and more preferably 10 to 25%, in the particulate compositions. The proportion of builder (total) will normally be in the range of 50 to 95%, preferably 60 to 95%, and more preferably, 60 to 80%. When bentonite is present it will be from 10 to 25% of the composition, such as 15 to 20%.

The liquid fabric conditioning compositions according to this invention are preferably aqueous and include the neoalkanamides in emulsified form rather than in solution because such neoalkanamides are normally water insoluble. To assist in emulsifying or solubilizing the neoalkanamide or a mixture thereof a nonionic surface active agent may be employed, preferably as an emulsifier for the neoalkanamide. Among various suitable nonionic surface active emulsifiers (and nonionic detergents may function as emulsifiers) may be mentioned alkyl phenoxypolyoxyethylene ethanols, alkylaryl polyether alcohols, polyglycol esters, oxyethylated alkyl phenols, low molecular weight polyamides, monoglycerides, ethoxylated fatty alcohols, ethoxylated fatty acids, fatty alkylolamine condensates, fatty alkanolamides, and many other nonionic emulsifiers, such as those listed in McCutcheon's *Detergents and Emulsifiers,* 1973 Annual. Instead of the nonionic emulsifiers, nonionic detergents may sometimes be useful, especially those of the Neodol ® class, which are made by Shell Chemical Company. As examples of such compounds there may be named Neodol 25-7, Neodol 23-6.5 and Neodol 45-11, all of which are condensates of higher fatty alcohols and ethylene oxide. It is also possible to employ anionic emulsifiers and amphoteric emulsifiers, but cationic emulsifiers are generally avoided, because of their adverse reactions with anionic detergents that may be present in the wash water.

The aqueous medium for the liquid state wash cycle fabric conditioning compositions is preferably deionized water but tap water may also be employed, although it will preferably be such water of less than 100 parts per million hardness, as calcium carbonate.

It has been found that the conditioning composition may be given fabric softening characteristics by inclusion in the composition formula of a tertiary amine fabric softening agent, which also appears to improve the antistatic activity of the neoalkanamide. Such a fabric softening tertiary amine will include at least one linear higher alkyl group of 10 to 18 carbon atoms and preferably will include two such groups, which may be different. A third alkyl or the remaining alkyls will be lower alkyl, of 1 to 4 carbon atoms, and preferably will be methyl. Thus, a highly preferred amine in such compositions is methyl di-(hydrogenated tallowalkyl) amine.

Preferred proportions of the components of the liquid composition are 5 to 20% of neoalkanamide, preferably neodecanamide, and more preferably tallowalkyl neodecanamide, 5 to 20% of nonionic surface active agent, preferably Neodol 25-3 (the condensation product of higher fatty alcohol of 12 to 15 carbon atoms with three moles of ethylene oxide), 10 to 30% of tertiary amine, preferably methyl di-(hydrogenated tallow) alkyl amine, and 30 to 70% of an aqueous medium, preferably deionized water, although water-ethanol mixtures are also useful, wherein the water:ethanol ratio is in the range of 1:1 to 10:1.

To manufacture the particulate wash cycle fabric conditioning composition of this invention it is preferred to spray dry an aqueous crutcher mix containing 50 to 70% by weight of solids, usually constituted primarily of builder material(s), in a commercial spray drying tower, at an elevated temperature, such as 250° to 400° C., to produce spray dried hollow globules or beads of particle sizes in the Nos. 8 to 140 range, preferably 10 to 100 range, U.S. Sieve Series. Such spray dried beads may include other components of a finished additive composition, such as normal detergent composition adjuvants, including fluorescent brighteners, colorants, e.g., pigments, polymeric materials, dispersing agents (to prevent setting up of the crutcher mix during processing) and, sometimes, bentonite or a portion thereof. The neoalkanamide is melted, often by being heated to 60° C., and is sprayed onto the surfaces of tumbling beds of the beads in an inclined drum mixer or other suitable mixer, such as a V-shaped twin shell blender. The balance of the bentonite of the formula may be agglomerated before mixing with the builder-neodecanamide combination or may be dusted onto such combination. Of course, the resulting product may be screened so that the particle sizes thereof are within a desired range.

To make the emulsion or other liquid product of the inventions it is only necessary to stir together the various components or to blend them together utilizing conventional mechanical or sonic emulsifying equipment.

Using the wash cycle fabric conditioning additive compositions is extremely simple and effective. All that is required is for the homemaker to add the desired amount of the wash cycle additive composition to the wash water in the tub of an automatic washing machine during the washing cycle, after the laundry, wash water and detergent composition of choice have been added, preferably after the detergent composition has been dissolved in the wash water. Normally the proportion of additive composition will be in the range of 0.2 to 2 grams per liter (g./l.), preferably 0.4 to 1.2 g./l., of a composition of this invention, either particulate or liquid. For a typical washing machine tub of 65 liter capacity the weight of additive employed will normally be in the range of 13 to 130 grams, preferably 26 to 78 grams, but for larger or smaller tubs the homemaker will soon learn from experience how much to employ to obtain best results.

After the fabric conditioning composition has been added to the wash water the standard wash cycle is commenced, followed by conventional rinsing, extracting (optional) and drying cycles, with the drying being in an automatic laundry dryer of the tumbling type (rotating drum). Even when the laundry being washed and dried includes synthetic polymeric fibers in the fabrics thereof, such as those made of polyester, polyether, acrylic and nylon fibers, and blends thereof, as with cotton, the washed and dried laundry is static-free.

With repeated uses of the invented compositions the homemaker can determine what quantity is best to use for household laundry and can adjust such amount to the minimum that will make the washed and dried laundry static free and soft, if fabric softener is included. In some instances it may be found that even less than the minimum of the 0.2 to 2 g./l. range given above may be useful but for most cases it is considered that the charge of the additive composition should be in such range for satisfactory results.

The following examples illustrate but do not limit the invention. Unless otherwise indicated, all parts and percentages mentioned in these examples and in the specification and claims are by weight and all temperatures are in °C.

EXAMPLE 1

| Component | Composition A (%) | Composition B (%) |
|---|---|---|
| Pentasodium tripolyphosphate (as phosphate solids, after spray drying) | 59.0 | — |
| Zeolite A hydrate (22% moisture of hydration) powder (through No. 200 sieve, U.S. Sieve Series) | — | 32.3 |
| Sodium carbonate (soda ash) | — | 23.5 |
| Sodium bicarbonate | — | 12.4 |
| Sodium silicate ($Na_2O:SiO_2$ = 1:2.4) | 9.8 | — |
| Bentonite powder (Mineral Colloid 101, Georgia Kaolin Co.) | — | 1.5 |
| Sodium polyacrylate (molecular weight = 2,000) | — | 0.5 |
| Magnesium sulfate, anhydrous | — | 1.1 |
| Fluorescent brighteners and dyes | 1.4 | 1.0 |
| Water | 9.8 | 7.7 |
| Tallow neodecanamide | 20.0 | 20.0 |
| | 100.0 | 100.0 |

To make the base beads of Composition A a 60% solids content aqueous crutcher mix containing the formula proportions of pentasodium tripolyphosphate, sodium silicate, fluorescent brightener and dye is made, heated to a temperature in the range of 70° to 95° C. and spray dried in a conventional spray drying tower, using heated drying air at a temperature in the range of 250° to 400° C., to hollow beads of globular shapes, which are within the particle size range of Nos. 10 to 100, U.S. Sieve Series. Oversized particles and fines are screened out when necessary, so that this desired particle size range of product is obtained.

Onto 80 parts by weight of such spray dried base bead composition there are sprayed 20 parts by weight of liquid state tallow neodecanamide at a temperature of 60° C. The neodecanamide antistatic agent covers the base beads and is partially (substantially) absorbed into the interiors of such beads, so that the particle size of the product resulting is not much different from that of the starting base beads, being in the 10 to 100 sieve range. After cooling to room temperature the product is found to be free flowing and noncaking on conventional storage before use.

The composition of Formula B is made in the same manner as described above for that of Forumula A, with all the components thereof except for the neodecanamide antistatic agent being in the crutcher mix, and with the neodecanamide, in liquid state, being sprayed onto the base beads of the other components. The product is also free flowing and non-caking.

In use, 40 grams of Composition A are added to the wash water (65 liters) in the tub of a General Electric home laundry automatic washing machine, which wash water already contained 0.15% (98 grams) of a commercial built synthetic anionic organic detergent composition. Such detergent composition comprises 13.4% of sodium linear tridecylbenzene sulfonate, 24% of sodium tripolyphosphate, 6.3% of sodium silicate ($Na_2O:SiO_2$=1:2.4), 4.5% of sodium carbonate, 1.0% of borax, 0.3% of fluorescent brighteners, 0.5% of methyl cellulose, 0.2% of sodium carboxymethyl cellulose, 49.6% of sodium sulfate and 0.2% of perfume, on an anhydrous basis (8% water). The wash water is at a temperature of 49° C. and the laundry load is 3.6 kilograms of mixed laundry, in which there are present test fabric swatches of Dacron®, Dacron-cotton blend, nylon and acrylic fabrics. After completion of the washing the washed laundry is rinsed and dried in an automatic laundry dryer of the type which incorporates a rotating drum having a substantially horizontal axis. After the completion of drying the laundry and test swatches are removed from the drum and are tested for static cling and for the presence of static charges thereon.

Compared to a control run, wherein the same type of laundry and test swatches are washed with the same type of detergent composition, but without the addition of the wash cycle fabric conditioning composition of this invention, the test swatches are significantly better in preventing the accumulation of static charges and in preventing static cling. Also, the additive composition does not reduce the cleaning power of the detergent composition, because the neoalkanamide, unlike quaternary ammonium halide softening agents, does not react with the anionic detergent, or with other components of the detergent composition.

It is considered that the description of the testing herein is sufficiently complete but if additional details are desired reference may be made to parent application Ser. No. 716,871, wherein in Example 5, at pages 26–28, test procedures that may be employed are described in greater detail.

The same test as described earlier in this example is carried out with Composition B being employed as the wash cycle fabric conditioning additive composition instead of Composition A. Formula B is intended for use with wash waters containing detergent compositions that are free of phosphate, whereas Formula A, which contains phosphate, is intended for use with phosphate-built products. Accordingly, such a non-phosphate commercial detergent composition will be employed in the wash water instead of the phosphate detergent composition previously described herein. Such a non-phosphate detergent composition may include the same percentages of components as in Formula B of the additive except for the replacement of the neoalkanamide with synthetic organic nonionic detergent, preferably Neodol 25-7. The comparative results against the control (non-phosphate detergent alone, without the wash cycle additive) are essentially the same as those for Formula A against its control, with static and static cling being apparent on the control test swatches but not being present or being significantly less on swatches treated with the appropriate wash cycle additive of this invention. Similarly too, there is no reduction in cleaning power of the control caused by the employment of the wash cycle additive; in fact, due to the presence of additional builder, it is expected that such cleaning power will normally be increased. When a quaternary ammonium halide salt or composition is employed as a wash cycle additive, instead of the neoalkanamide, in the compositions of this invention, measurable and significant decreases in detergency are noted for the compositions incorporating the quaternary salt.

In a modification of the experiments of this example, instead of the base beads being spray dried, the various solid components are mixed together in particulate form, and any liquid materials, other than neoalkanamide, are mixed in or dried and then mixed with the other solids. If desired, some such materials may be agglomerated before such mixing. Subsequently, the neoalkanamide, preferably in liquid form, is sprayed onto or mixed into the bed of particulate materials to produce the final additive compositions. Such compositions are equally satisfactory with respect to rendering the test swatches antistatic and non-clinging but are not as attractive in appearance and are not as good in flow properties and resistance to caking on storage as are the compositions based on spray dried base beads.

Instead of employing a major proportion of builder salt, some of such builder, up to about half the total, may be replaced by filler salts, such as sodium sulfate, without the desirable antistatic results being significantly adversely affected. Also, instead of tallowalkyl neodecanamide, tallowalkyl neopentanamide and other tallowalkyl neoalkanamides, such as the corresponding neononanamide, neododecanamide and neotetradecanamide, or mixturesthereof, may be employed, and the swatches washed will also be antistatic. Similarly, the various mentioned neoalkanamides may be those of hydrogenated tallowalkyl, cocoalkyl, myristyl, dodecyl, palmityl and stearyl, as well as oleyl, and mixtures thereof, and the reported desirable antistatic results will be obtained.

EXAMPLE 2

| Component | Composition C (%) | Composition D (%) |
|---|---|---|
| Pentasodium tripolyphosphate (as phosphate solids, after spray drying) | 49.0 | — |
| Zeolite A hydrate (22% moisture of hydration) powder (through No. 200 sieve, U.S. Sieve Series) | — | 26.8 |
| Sodium carbonate (soda ash) | — | 19.5 |
| Sodium bicarbonate | — | 10.3 |
| Sodium silicate ($Na_2O:SiO_2$ = 1:2.4) | 8.1 | — |
| Bentonite powder (Mineral Colloid 101, Georgia Kaolin Co., in spray dried base beads) | — | 1.3 |
| Sodium polyacrylate (molecular weight = 2,000) | — | 0.4 |
| Magnesium sulfate, anhydrous | — | 0.9 |
| Fluorescent brighteners and dyes | 1.2 | 0.8 |
| Water | 8.1 | 6.4 |
| Bentonite powder (Mineral Colloid No. 1) | 16.6 | 16.6 |
| Perfume | 0.4 | 0.4 |
| Tallow neodecanamide | 16.6 | 16.6 |
| | 100.0 | 100.0 |

Wash cycle additive Compositions C and D are made in essentially the same manner as described for Compositions A and B of Example 1, and are tested in similar manners. The 16.6% of bentonite powder employed in Compositions C and D (in addition to the 1.3% earlier indicated for Composition D), may be agglomerated and mixed with the spray dried material before perfuming and spraying thereon of the neoalkanamide, or may be dusted onto the base beads that have been sprayed or mixed with neoalkanamide. Normally, the perfume is sprayed on last but exceptions may be made to this general rule, too. As in Example 1, the C and D compositions are utilized with phosphate-containing built anionic synthetic organic detergent composition and with no-phosphate compositions, respectively. However, because it has been noticed that the presence of the bentonite appears to have some negative effect on the antistatic action of the neoalkanamide in these products, more neoalkanamide will usually be employed. Thus, instead of the 40 grams of additive composition utilized in Example 1, 60 grams of the present formulas will be employed, which are equivalent to 10 grams per wash load of neoalkanamide instead of 8 grams per wash load. Another change in the test procedure is in the inclusion of cotton test swatches for softness evaluations, which evaluations are made by a panel of experienced evaluators.

The same types of antistatic and non-clinging results reported for Example 1 are also obtained for the compositions of Example 2, and additionally, the cotton test swatches are found to be significantly softer to the touch for the experimental than for the controls (in which no wash cycle antistatic additives are employed).

EXAMPLE 3

| Component | Composition E (%) | Composition F (%) |
|---|---|---|
| Tallow neodecanamide | 17.3 | 13.9 |
| Nonionic surface active agent (Neodol 25-7) | 16.5 | 13.3 |
| Fabric softening tertiary alkyl amine [methyl di-(hydrogenated tallow) amine] | — | 19.5 |
| Water, deionized | 66.2 | 53.3 |
| | 100.0 | 100.0 |

The liquid emulsions of the above formulas are made by mixing together the various components in desired order. Preferably, the neoalkanamide and amine are first mixed together with the nonionic surface active agent or emulsifier, before such mixture is added to the water. The emulsion made is of satisfactory stability but if a portion thereof should settle out, it may be redispersed therein by gentle shaking. The neoalkanamide acts to diminish static charge accumulation of machine washed and automatically dried laundry and the amine helps to soften the laundry. The surface active agent acts as an emulsifier but also contributes detersive action to the wash water. The weights of wash cycle additives employed (added to 65 l. of wash waters), are 29 grams of Composition E and 36 grams of Composition F, so that the neoalkanamide contents of both such charges are the same.

Compositions E and F prevent static charge accumulations on the swatches tested and Composition F additionally softens the laundry and the test swatches, especially the cotton swatches, compared to a control washing and drying, in which no wash cycle additive was employed.

In variations of the above formulas, other alkyl groups may be substituted for the tallow alkyl and other neoalkanoic acids may be employed in manufacturing the neoalkanamide, as described in Example 1, and similar desirable antistatic effects will be obtained. Similarly, other fabric softening tertiary alkyl amines may be utilized, as described in the specification, and good fabric softening will result. Of course, instead of the nonionic surface active agent described, other emulsifiers and surface active agents may be employed, sometimes together with solvents and stabilizers, to improve emulsion stability and homogeneity of the additive product.

The invention has been described with respect to various illustrations and examples thereof but is not to be limited to these because it will be evident that one of skill in the art, with the present specification before him, will be able to utilize substitutes and equivalents without departing from the invention.

What is claimed is:

1. A wash cycle fabric conditioning composition which comprises an antistatic proportion, sufficient to impart antistatic characteristics to laundry during washing when the fabric conditioning composition is charged to wash water during the wash cycle at a concentration of 0.2 to 2 g./l., of antistatic N-higher alkyl neoalkanamide or antistatic N-higher alkenyl neoalkanamide or a mixture thereof, wherein the higher alkyl or higher alkenyl is of a number of carbon atoms in the range of 8 to 20 and the neoalkanoic acid moiety is of 5 to 16 carbon atoms, and a particulate carrier or liquid medium for the amide which is a builder or filler suitable for building a detergent or filling it, or is an aqueous medium containing a nonionic surface active agent.

2. A wash cycle fabric conditioning composition according to claim 1 wherein the antistatic compound is a n-higher alkyl neoalkanamide and the proportion thereof present in the fabric conditioning composition is in the range of 5 to 30%, by weight.

3. A fabric conditioning composition according to claim 2 which is in particulate form and which comprises 5 to 30% of N-higher alkyl neodecanamide, and 50 to 95% of particulate builder salt which is a polyphosphate, carbonate, bicarbonate, sesquicarbonate, silicate, sesquisilicate, polyacetal carboxylate, borate, zeolite or mixture thereof.

4. A composition according to claim 3, of improved fabric softening capability, which comprises from 10 to 25% of N-higher alkyl neodecanamide wherein the higher alkyl is of 10 to 18 carbon atoms, 10 to 25% of bentonite,and 60 to 80% of builder, which is a polyphosphate, carbonate, bicarbonate, silicate or zeolite, or a mixture thereof.

5. A composition according to claim 3 wherein the N-higher alkyl neodecanamide is tallowalkyl neodecanamide and the carrier is spray dried detergent builder beads of particle sizes in the Nos. 10 to 100 sieve range, U.S. Sieve Series, and the tallowalkyl neodecanamide coats and penetrates the spray dried beads of carrier.

6. A wash cycle fabric conditioning composition according to claim 2 which is in liquid form and which comprises 5 to 20% of tallowalkyl neodecanamide, 5 to 20% of nonionic surface active agent, 10 to 30% of a tertiary amine fabric softening agent and 30 to 70% of an aqueous medium.

7. A fabric conditioning composition according to claim 6 in which the tertiary amine fabric softening agent is a mono-lower alkyl di-(hydrogenated tallow) amine and the aqueous medium is water.

8. A process of manufacturing a composition of claim 1 which comprises spraying liquid state antistatic N-higher alkyl neoalkanamide or antistatic N-higher alkenyl neoalkanamide or a mixture thereof onto the surfaces of or mixing such liquid state material with particulate builder salt of particle sizes in the range of Nos. 10 to 100, U.S. Sieve Series, which particulate material is a polyphosphate, carbonate, bicarbonate, sesquicarbonate, silicate, sesquisilicate, polyacetal carboxylate, borate, zeolite or mixture thereof, so as to form a free flowing, particulate wash cycle fabric conditioning composition.

9. A process for conditioning laundry to make it resistant to accumulations of static charges which otherwise would be present after washing said laundry in an automatic washing machine and drying it in an automatic laundry dryer, which comprises adding to wash water in said washing machine during the wash cycle 0.2 to 2 g./l. of a composition described in claim 1.

10. A process according to claim 9 wherein the wash cycle fabric conditioning composition is in particulate form with the particulate detergent builder carrier being spray dried beads of sizes in the Nos. 10 to 100 sieve range, U.S. Sieve Series, of a water soluble polyphosphate, carbonate, bicarbonate, sesquicarbonate, silicate, sesquisilicate, polyacetal carboxylate, borate, zeolite or mixture thereof, with the antistatic neoalkanamide being tallowalkyl neodecanamide that coats and penetrates the builder beads, and with the percentages of tallowalkyl neodecanamide and builder being in the ranges of 5 to 30% and 50 to 95%, respectively.

11. A process according to claim 9 wherein the wash cycle fabric conditioning composition is in liquid state and comprises 5 to 20% of tallowalkyl neodecanamide, 5 to 20% of nonionic surface active agent, 10 to 30% of a tertiary amine fabric softening agent, and 30 to 70% of water.

12. A process for making laundry resistant to accumulations of static charges which otherwise would be present on it after washing such laundry in an automatic washing machine and drying it in an automatic laundry dryer, which comprises adding to wash water in the washing machine during the wash cycle an antistatic proportion of antistatic N-higher alkyl neoalkanamide or antistatic N-higher alkenyl neoalkanamide or a mixture thereof, wherein the higher alkyl or higher alkenyl is of a number of carbon atoms in the range of 8 to 20 and the neoalkanoic acid moiety is of 5 to 16 carbon atoms.

* * * * *